US011508534B2

(12) United States Patent
Bossoni et al.

(10) Patent No.: US 11,508,534 B2
(45) Date of Patent: Nov. 22, 2022

(54) SWITCH AND CHANGEOVER SWITCH WITH COMPACT STRUCTURE

(71) Applicant: MICROELETTRICA SCIENTIFICA S.P.A, Buccinasco (IT)

(72) Inventors: Carlo Bossoni, Milan (IT); Davide Faioni, Milan (IT)

(73) Assignee: MICROELETTRICA SCIENTIFICA S.P.A

( * ) Notice: Subject to any disclaimer, the term of this patent is extended or adjusted under 35 U.S.C. 154(b) by 0 days.

(21) Appl. No.: 17/277,227

(22) PCT Filed: Aug. 27, 2019

(86) PCT No.: PCT/EP2019/072763
§ 371 (c)(1),
(2) Date: Mar. 17, 2021

(87) PCT Pub. No.: WO2020/057901
PCT Pub. Date: Mar. 26, 2020

(65) Prior Publication Data

US 2022/0059299 A1 Feb. 24, 2022

(30) Foreign Application Priority Data

Sep. 17, 2018 (EP) ..... 18194790

(51) Int. Cl.
*H01H 3/46* (2006.01)
*H01H 3/26* (2006.01)
(Continued)

(52) U.S. Cl.
CPC ..... *H01H 3/46* (2013.01); *H01H 3/26* (2013.01); *H01H 31/023* (2013.01);
(Continued)

(58) Field of Classification Search
CPC ..... H01H 3/46; H01H 3/26; H01H 31/023; H01H 31/026
(Continued)

(56) References Cited

U.S. PATENT DOCUMENTS 2,041,250 A 5/1936 Kalwitz
2013/0319831 A1 12/2013 Thompson

FOREIGN PATENT DOCUMENTS

DE 977546 * 12/1966 ..... H01H 19/635
DE 977546 C 12/1966
(Continued)

OTHER PUBLICATIONS

International Search Report and Written Opinion corresponding to PCT/EP2019/072763 dated Nov. 18, 2019.

*Primary Examiner* — Edwin A. Leon
*Assistant Examiner* — Iman Malakooti
(74) *Attorney, Agent, or Firm* — Barnes & Thornburg LLP

(57) ABSTRACT

A switch includes a switch body, for containing switch components, at least two terminal contacts, protruding from the switch body, at least one movable contact, which is movable from an operative position, wherein the movable contact is electrically coupled between the at least two terminal contacts, and a disconnecting position, wherein the movable contact is electrically uncoupled between the at least two terminal contacts. The switch also includes a moving mechanism including an electric motor and a support sliding element for the movable contact, driven by the moving mechanism and the electric motor, to move the movable contact between the operative condition and the disconnecting position.

11 Claims, 3 Drawing Sheets

(51) Int. Cl.
*H01H 31/02* (2006.01)
*H01H 31/24* (2006.01)
*H01H 3/40* (2006.01)

(52) U.S. Cl.
CPC ..... *H01H 31/026* (2013.01); *H01H 31/24* (2013.01); *H01H 3/40* (2013.01)

(58) Field of Classification Search
USPC ..... 200/48 KB
See application file for complete search history.

(56) References Cited

FOREIGN PATENT DOCUMENTS

| | | | | | |
|---|---|---|---|---|---|
| FR | 2884643 | | * | 10/2006 | ..... H01H 3/26 |
| FR | 2884643 | A1 | | 10/2006 | |
| JP | 2878417 | B2 | | 4/1999 | |
| RU | 2173498 | C2 | | 9/2001 | |
| RU | 2308780 | C1 | | 10/2007 | |

* cited by examiner

SWITCH AND CHANGEOVER SWITCH WITH COMPACT STRUCTURE

CROSS REFERENCE AND PRIORITY CLAIM

This patent application is a U.S. National Phase of International Patent Application No. PCT/EP2019/072763 filed Aug. 27, 2019, which claims priority to European Patent Application No. 18194790.4, the disclosure of which being incorporated herein by reference in their entireties.

FIELD

The disclosed embodiments relate to switches and changeover switches with an inventive structural and functional configuration in order to achieve a more compact structure.

More specifically, but not exclusively, the disclosed embodiments relate to a changeover switch suitable for industrial application with high current involved, especially in the railways field.

BACKGROUND

As it is well known in this specific technical field, a switch is an electrical component that can "make" or "break" an electrical circuit, interrupting the current or diverting it from one conductor to another. The mechanism of a switch removes or restores the conducting path in a circuit when it is operated.

A particular type of switch is a disconnector. A disconnector is used to ensure that an electrical circuit is completely de-energized for service or maintenance. Such switches are often found in electrical distribution and industrial applications, where machinery must have its source of driving power removed for adjustment or repair. High-voltage isolation switches are used in electrical substations to allow isolation of apparatus such as circuit breakers, transformers, and transmission lines, for maintenance. The disconnector is usually not intended for normal control of the circuit, but only for safety isolation. Disconnectors can be operated either manually or automatically.

Unlike load switches and circuit breakers, disconnectors lack a mechanism for suppression of electric arcs, which occurs when conductors carrying high currents are electrically interrupted. Thus, they are off-load devices, intended to be opened only after current has been interrupted by some other control device.

SUMMARY

Disclosed embodiments are directed at providing a switch with a more compact configuration, wherein the switch may provide a more efficient operation in terms of nominal current flow, supporting a high level of short circuit currents and/or a higher reliability and a long operating life, wherein the switch device does not require complex manufacturing costs but also provides easy installation on a complex electrical system.

Disclosed embodiments, therefore, provide a more compact mechanism able to provide an efficient break in the interconnection between at least two contacts, and at the same time establish a connection with another contact, if required.

BRIEF DESCRIPTION OF FIGURES

Further features of the switch of the disclosed embodiments will appear from the following description given by way of not limiting examples with reference to the enclosed drawings figures.

DETAILED DESCRIPTION

Figure 1:
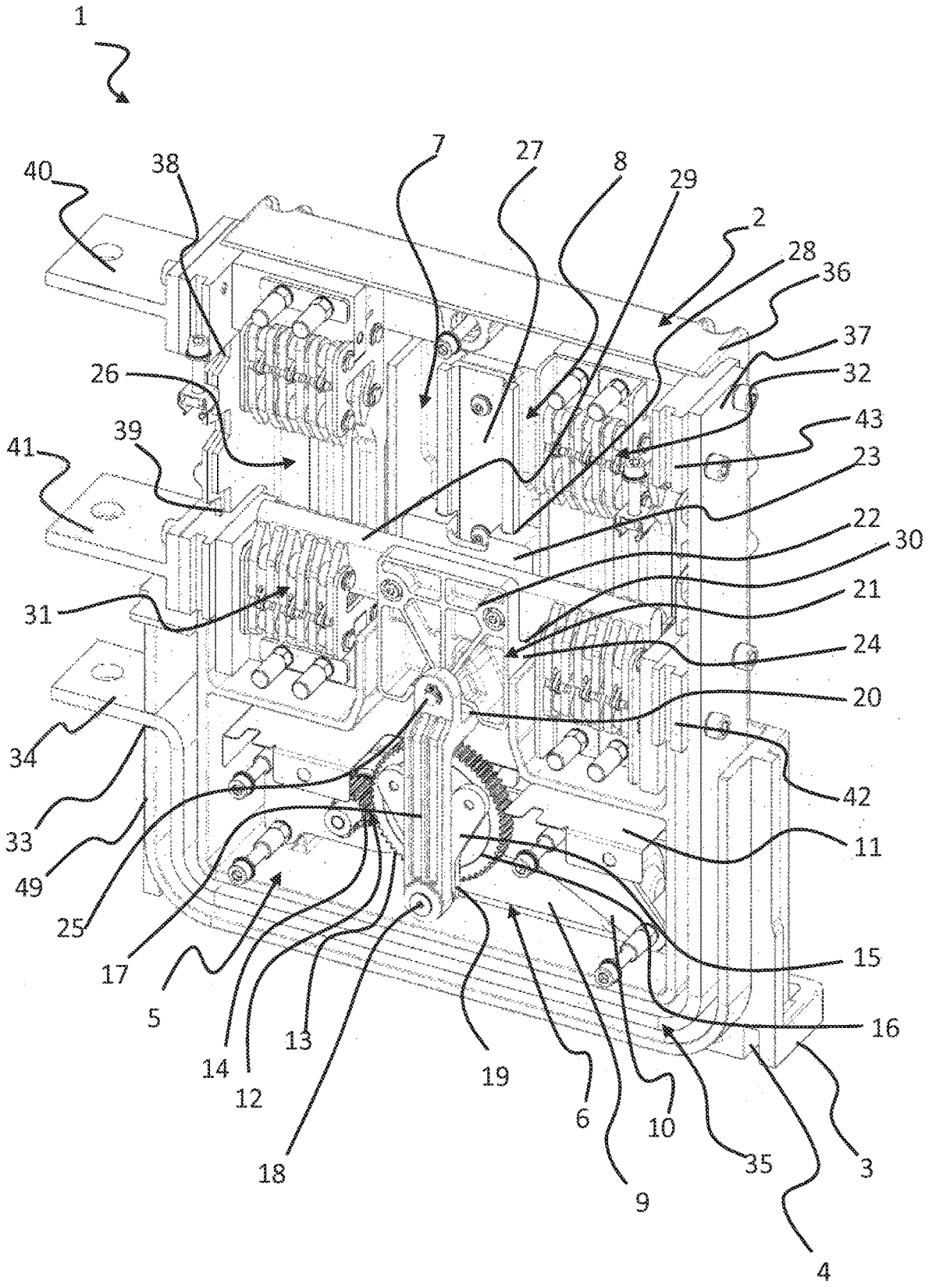
FIG. 1 shows a perspective view of a switch realized according to the disclosed embodiments.

In some applications of the known type, when a contact is interrupted, it is also possible to establish a connection with a different electrical circuit using another contact.

That is the case of the so-called "changeover contacts" or "changeover switch," wherein precisely a set of three electrical contacts is provided and a contact to one device is interrupted and then established with another. Control of the contacts can be either manual or part of a disconnector under electronic control. A disconnector may consist of more than one set of changeover contacts.

A set of three contacts is called a pole. A changeover disconnector can have one or more poles. The contacts in a pole can consist of materials like tungsten, silver alloys, or gold plating, which are hard and resistant to burnout and corrosion, or simple copper if no presence of electric arc is foreseen.

Changeover switches can have different configurations: SPDT or Single Pole switch is a toggle that just switches from one device to the other, instead a Double Throw or SPDT Center Off switch has two "On" positions and one "Off" position.

However, this type of switches is generally too big, especially in those applications wherein it is necessary an optimization of space to organize as many electrical circuits as possible.

In sight of this, for example, the Patent Application JP 2,878,417 B2 describes a changeover switch, that uses an arrangement with two parallelly connected lead switches to require less space.

Despite of the undoubted advantages provided by this arrangement, there are still drawbacks especially for the needs of a more complex inner construction and for the size increase on the other size due to this particular arrangement.

The technical problem underlining the disclosed embodiments is that of providing a switch with a more compact configuration.

Accordingly, the disclosed embodiments provide a switch that may guarantee a more efficient operation in terms of nominal current flow, supporting a high level of short circuit currents.

Disclosed embodiments may also provide a switch which may guarantee a higher reliability and a long operating life.

Still further, disclosed embodiments may provide a switch device that does not require complex manufacturing costs.

Finally, disclosed embodiments may provide a switch, that may guarantee an easy installation on a complex electrical system.

Thus, disclosed embodiments provide a more compact mechanism able to provide an efficient break in the interconnection between at least two contacts, and at the same time establish a connection with another contact, if required.

The technical problem is solved by a switch comprising a switch body, suitable for containing switch components, at least two terminal contacts, protruding from the switch body, at least one movable contact, which is movable from an operative position, wherein the movable contact is electrically coupled between the at least two terminal contacts, and a disconnecting position, wherein the movable contact is electrically uncoupled from the at least two terminal contacts. Such a switch may further include a moving mechanism comprising an electrical motor, and a support sliding element for the movable contact, driven by the moving mechanism and the motor, to move the movable contact between the operative position and the disconnecting position, the movable contact being a plate rod extended transversely with respect to the support sliding element.

Optionally, the switch body is suitable for containing all switch components.

Optionally, the movable contact is suitable for establishing a physical and electrical connection between the at least two terminal contacts, and for dislodging the physical and electrical connection between the at least two terminal contacts.

This structure guarantees to obtain a switch that allows a sure and effective electrical connection and disconnection.

Moreover, the switch comprises at least one releasable gripping means for each position of the movable contact for gripping at least one end of the movable contact.

Advantageously, this releasable gripping means guarantees the correct positioning and support of the movable contact for the electrical connection.

According to a particular aspect of the disclosed embodiments, the switch comprises at least two releasable gripping means fixed in the switch body in correspondence of each position to be reached by the movable contact and wherein the at least two releasable gripping means are located in these positions at two opposite ends of the movable contact.

Advantageously, thanks to this particular configuration, the switch is good structurally balanced avoiding also possible deformation of movable contact and incorrect connection between switch components.

According to another aspect of the disclosed embodiments, the switch further comprises at least a guide system, centrally extended along a central axis of the switch body, in order to guide the movable contact between operative and disconnecting positions; the plate rod being extended transversely with respect to the guide.

This particular aspects allows a quick and correct movement between operative and disconnecting positions.

Optionally, the moving mechanism is a rotative kinematic mechanism.

According to a particular aspect of the disclosed embodiments, this rotative kinematic mechanism comprises at least a couple of gears, moved by the motor, the couple of gears moving in turn at least a rod, the rod being connected to the support sliding element of the movable contact, in order to move the movable contact between the operative position and the disconnecting position.

Advantageously, this structure configuration allows a very compact global structure of the switch, guaranteeing at the same time an efficient operation.

According to a particular aspect of a changeover switch, it is provided a further third fixed terminal contact, so that while a connection between two contacts is broken, it is established a connection between two other contacts.

Optionally, according to the latter aspect, the motor moves at least one movable contact between a first position, establishing a physical and electrical connection between two terminal contacts, and a second position, establishing a physical and electrical connection between other two terminal contacts including the third fixed contact, contemporary dislodging the physical and electrical connection of the first position.

This solution is compact and quick in the establishment of different electrical connections within the switch.

According to a further aspect, at least one terminal contact is connected to a contact bar that runs on the perimeter of the switch body.

Optionally, the movable contact can be coupled to the contact bar in different operative position by at least one connecting portion.

According to another preferred aspect, the switch body is connectable in a modular way to similar switch bodies. This aspect allows to create such a single space-safe structure, suitable for more complex operation of electrical connection and disconnection.

Finally, it must be noted that the switch is adapted to be implemented in a corresponding electrical system, adapted especially but not only for high voltage application.

With reference to the drawing figures, with 1 is globally and schematically shown a changeover switch, realized according to the disclosed embodiments.

The switch is specifically provided for industrial applications wherein a high D.C. current circuit must be connected or disconnected with safe and reliable actions.

The changeover switch 1 provides a switch body 2 including all the moving portions of the switch 1 that will be disclosed hereinafter.

In the specific embodiment shown in FIG. 1 it will be disclosed specifically a changeover switch, but the same mechanism can be applied in a disconnector.

In the described exemplary embodiment of FIG. 1, the switch body has substantially a parallelepipedial shape with a depth much lower than other two dimensions.

Moreover, in particular, FIG. 1 shows a switch 1 according to the disclosed embodiments with a front surface removed in order to show the elements contained in the switch body 2 but the motor, having not been depicted therein in order to show the underlaying elements.

The switch body 2 comprises a base 3, suitable for connection by a couple of notches 4 within a more complex system, or simply as a support for the switch 1.

The switch 1 is internally divisible in two main portions, a lower portion 5 in proximity of the base 3, wherein a moving mechanism 6 is housed, and a higher portion 7, which stands above the lower portion 5, wherein an electrical connection group 8 is housed. These space references are referred to an installation of the switch extended in a vertical position.

The moving mechanism 6 comprises electrical motor 9. The motor 9 in a preferred embodiment are an electric motor. The moving mechanism 6 is Optionally a rotative kinematic mechanism.

The motor is covered by horizontal bulkhead 11, to protect the motor 9 and to divide the lower portion 5 and the higher portion 7.

The motor is operatively connected to a gear system 12 comprising a main gear 13 and a secondary gear 14. The tooth meshing takes place in a direction of the depth of the switch body.

A shaft 15 is connected on a plane surface 16 of the main gear 13. In the exemplary embodiment represented in FIG. 1, the shaft has a three lobes shape, for a better distribution of the force.

A rod 17 is connected on one end 18 to one lobe 19 of the shaft 15. So, the rotation of the main gear 13 causes the rotation of the shaft 15 and consequently a translational movement of the rod 17.

In other words, the shaft 15 and the rod 17 represent a piston rod/crankshaft mechanism.

The rod 17 represent also a connection between lower portion 5 and higher portion 7.

On the opposite end 20, the rod 17 has a U-shaped section in a direction of a depth of the switch body 2.

The cavity of the U-shaped opposite end 20 is complementary with a support sliding element 21.

The support sliding element 21 comprises a front plate 22 and a rear plate 23, parallelly disposed, transversally connected by a connecting portion 24 on the direction of the depth of the switch body, about at mean size of the front plate 22 and rear plate 23. In other words, the support sliding element is H-shaped in the direction of the depth of the switch body 2.

The front plate 22 has a rectangular section with a recess 25 on the lower side facing the rod 17. The recess 25 is inserted in the cavity of the U-shaped opposite end 20 of the rod 17, and Optionally fixed by a transversal pin.

The rear plate 23 is on a rear surface 26 of the switch body 2.

Optionally between rear plate 23 and the rear surface 26 is interposed a guide 27 along a central axis of the switch body 2. In the described embodiment, the guide 27 has an omega-profile and the rear plate 23 has corresponding shape with grooves 28 to slide on guide 27.

Nothing refrains to use other types of guides 27 over which the support sliding element 21 can slide.

A movable contact 29 is placed on an upper side 30 of the connecting portion 24, and it is fixed, for example, by screw or bolt. The movable contact 29 is a plate rod or bar extended transversely with respect to the guide 27.

So, the sliding of the support sliding element 21 causes the translational movement of the movable contact 29.

At the lower position of the support sliding contact 21 and of the movable contact 29, a couple of gripping means 31 is provided for both the electrical connection and the gripping action at the opposite end of the plate bar movable contact 29. These gripping means 31 are upwardly oriented.

Conversely, at the upper position of the support sliding contact 21 and of the movable contact 29, a couple of opposite gripping means 32 is provided at the opposite end of the movable contact 29, the gripping portion of the opposite gripping means 32 facing the gripping portion of gripping means 31, so being downwardly oriented.

So, the movable contact 29 is moved by the support sliding contact 21 between two extremity positions wherein it is blocked in position by the gripping means 31 and the opposite gripping means 32, respectively.

In the particular embodiment shown through the figures the gripping means 32 are particular miniaturized pliers, but nothing refrains to use other different releasable locking means, without departing from the scope of protection defined by the invention.

Nothing refrains also to use only one gripping mean 32 for each movable contact 29 position.

It is preferred using the two gripping means 32 configuration for each movable contact 29 position because this configuration guarantees better structural balancing.

An opening 33 is provided on a lateral side 49 of the switch body 2.

A terminal contact 34 projects through such opening 33.

The terminal contact 34 is associated to a contact bar 35, which runs peripheric from the opening 33 on the lateral side 49 to an upper end 36 of the opposite side 37 of the switch body 2.

Two other openings 38 and 39 are provided parallel to the opening 33 at the two extremity positions of the movable contact 29.

Two corresponding terminal contacts 40 and 41 projects from openings 38 and 39. In a disconnector only a terminal contact 40 projecting from an opening 38 is provided.

Two corresponding connecting elements 42 and 43 are provided at the opposite side 37 of the openings 38 and 39, in contact with the contact bar 35. When the movable contact is at its extremity positions, the connecting elements 42, 43 allow to connect the contact bar 35 with the movable contact 29 and to the corresponding terminal contacts 40 or 41, respectively.

In other words, two alternative connection configurations are provided between the terminal contact 34 and the terminal contacts 40, 41, respectively, depending on the position of the movable contact 29 along the contact bar 35.

In case the terminal contact 34 is positioned at an opposite side with respect to the corresponding terminal contact 41, no contact bar 35 is needed for a correct working of the switch 1.

Moreover, in case of a simple disconnector, only one connecting element 42 is provided.

Other configurations are possible without to depart from the scope of protection defined from the invention. It is possible to provide different locations of the terminal contacts 34, 40, 41, for example on opposite or different sides of the switch body 2 through corresponding openings (33, 38, 39, and an opening close to terminal 42, not shown in the picture) depending on the required connection configuration.

Figure 2:
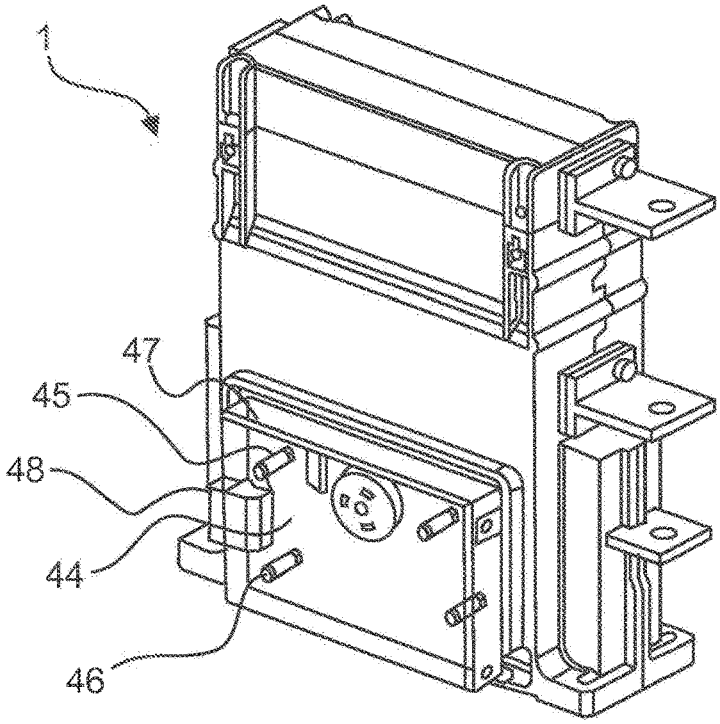
FIG. 2 shows a rear perspective view of the switch of FIG. 1.

Another important feature of the switch 1 according to the disclosed embodiments, shown in FIG. 2, is the presence of an electronic board 44 associated to rear side of the switch 1 outside the switch body 2.

This electronic board 44 is provided to regulate the electric supply to the motor 9. More specifically, in the present exemplary but not limitative embodiment the electronic board 44 is structured to supply the correct voltage and current values to the coil for predetermined scheduled times.

These correct voltage and current values are supplied independently from the possible excursions of the control voltage supply and in a range of operating temperatures variable between −40° C. and +75° C.

The high reliability operating conditions of the electronic board 44 are guaranteed by the presence of heat dissipating elements and circuit recovery means mounted on the electronic board 44.

Moreover, the control board 44 is provided with a proper level of immunity against radiated and conducted disturbances according to the more severe railway requirements.

A further specific insulation of at least 1500 V (at 50 Hz and for 60 s) toward ground is provided.

The electronic board 44 is mounted at a predetermined small distance from the switch body 2. In this respect, supporting columns 45 are provided on the rear surface of the switch body 2.

These supporting columns 45 are integrally formed in the structure of the switch body 2 with a cylindrical shape with open end for hosting the insertion of a fixing screw 46.

A protection coverage 47 is provided over the electronic board 44 with holes 48 for the passage of the fixing screw 46. This protection coverage 47 is Optionally squared with round shaped edges.

An external electronic connection 48 is provided from the electronic board, passing through a specific hole in the protection coverage 47.

Figure 3:
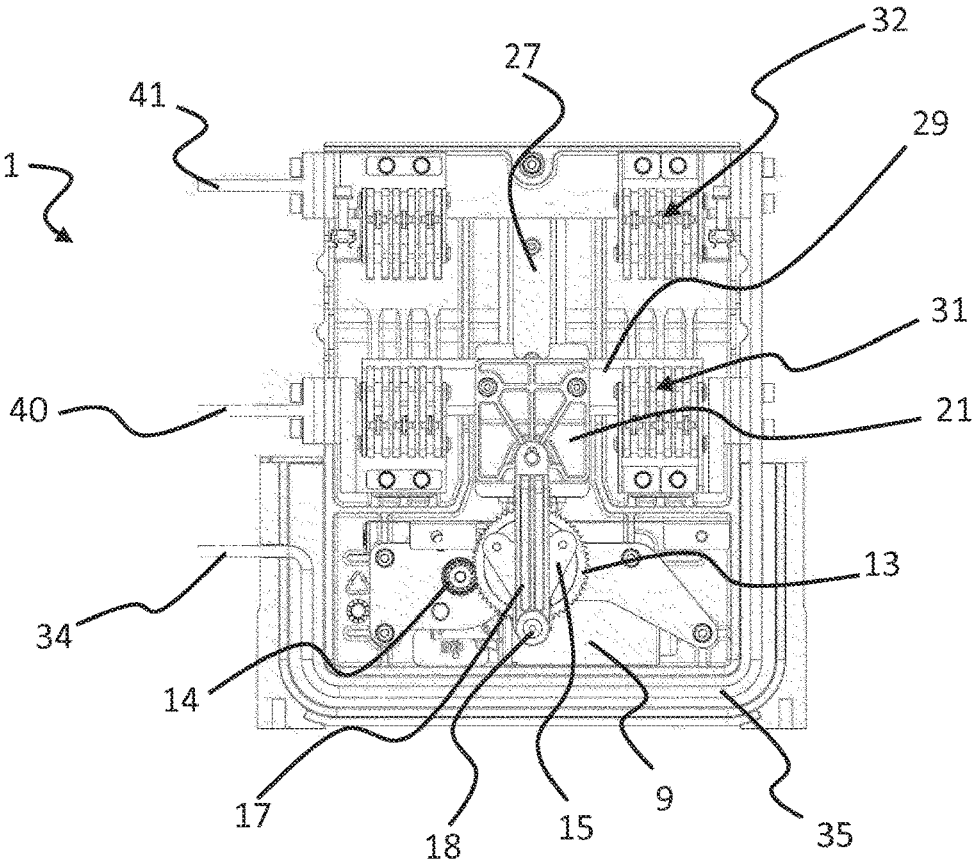
FIG. 3 shows a front schematic view of the switch of FIG. 1, in an operative configuration.
Figure 4:
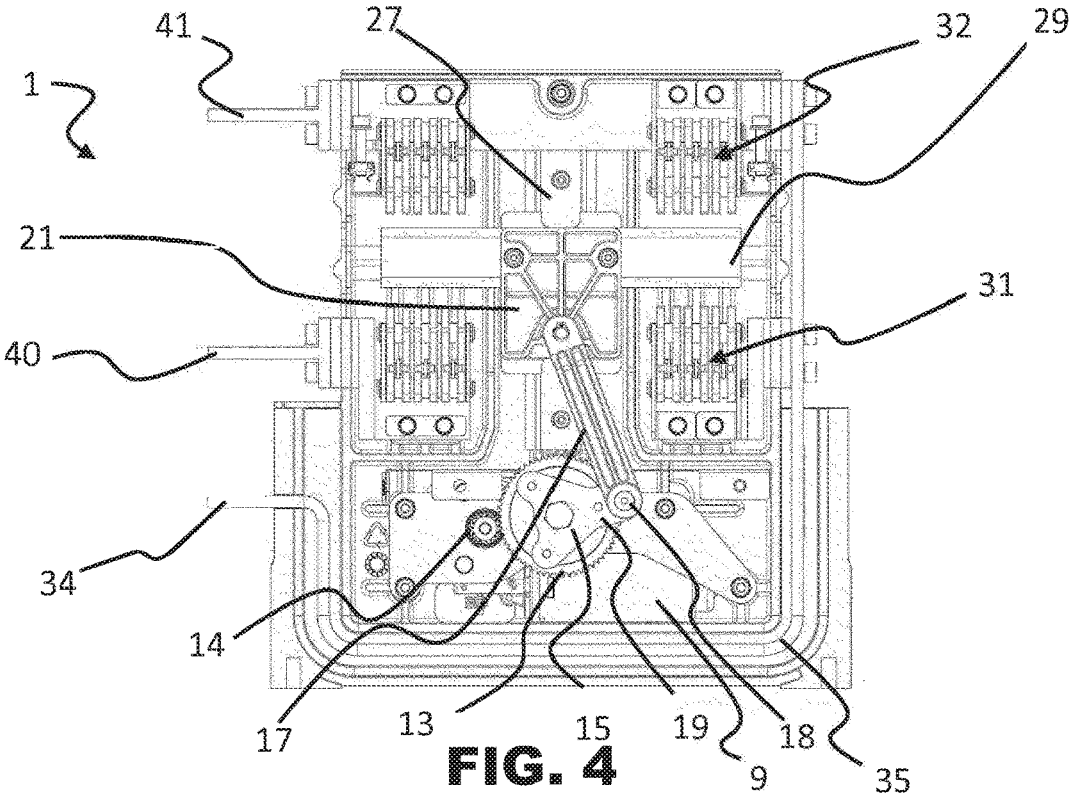
FIG. 4 shows a front schematic view of the switch of FIG. 1, in a further operative configuration.
Figure 5:
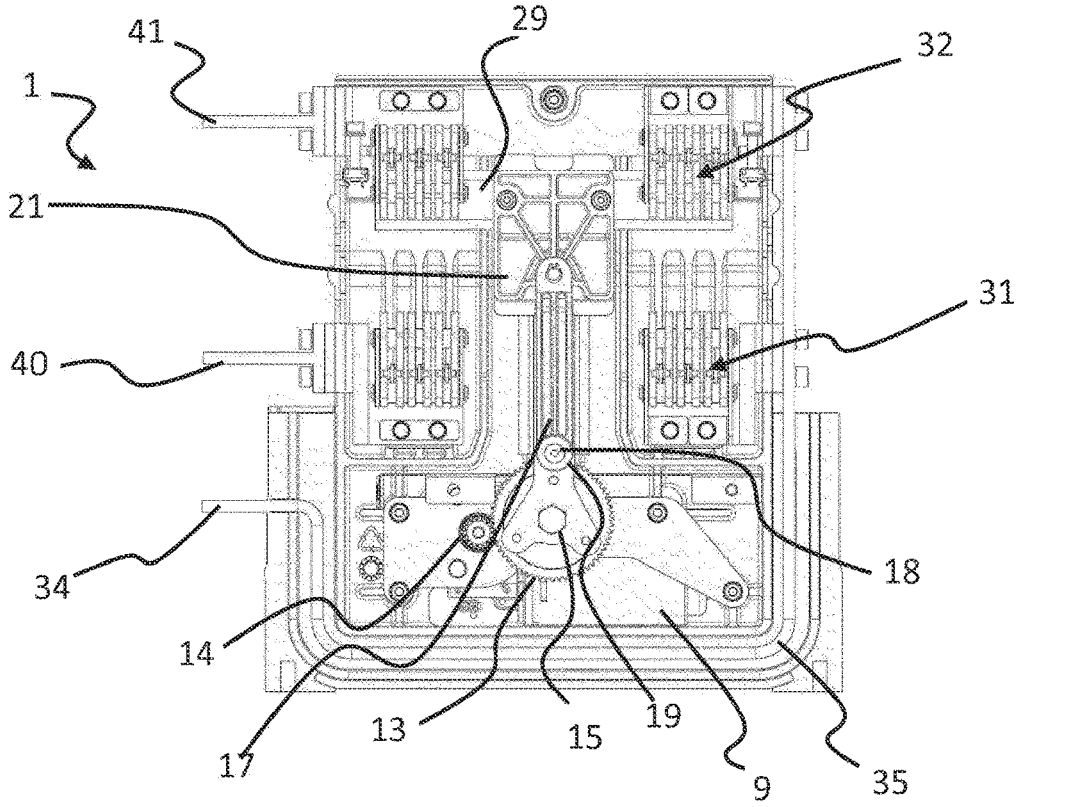
FIG. 5 shows a front schematic view of the switch of FIG. 1, in a further operative configuration.

It will be described below the operation of the switch according to the disclosed embodiments, in particular looking at the exemplary FIGS. 3 to 5 that show three phases during the movement of moving mechanism 6.

The actuation of motor 9 put in rotation the gear system 12. The rotation of the main gear 13, causes the rotation of the shaft 15 connected on the plane surface of the main gear 13. The rotation of the shaft 15 causes a translational move of the rod 17, whose one end is connected to one end the shaft 15. The translational movement of the rod 17 causes a pull or push action on the support sliding element 21, and consequently of the movable contact 29. At the extremity positions of the support sliding element 21 and of the movable contact 29 at least one, Optionally two, gripping means 32 are provided in order to keep in position the movable contact 21. At each extremity position of the movable contact 29 one terminal contact 40, 41 projects outside the switch body 2. The movable contact 29 creates an electrical path with such terminal contacts 40 or 41, a connecting element 42 or 43 on the opposite side of the switch body 2, a contact bar 35, in contact with such connecting element and which runs peripheric to a terminal contact 34, which is in the present embodiment on the same side of the terminal contacts 40, 41.

It is possible in this way to switch between two possible electrical paths by the movement of the movable contact 29 operatively connected to moving mechanism 6.

In a normal disconnector only two terminal contacts 34, 40 are provided, so the rotation of the gear system 12 and of the shaft 15, and the consequent translational movement of the rod 17 and of the support sliding element 21, simply causes the movement of the movable contact 29 between an operative position with an electrical connection between the terminal contacts 34, 40, and a disconnecting position.

Advantageously, the switch 1 has a compact structure guaranteed from the particular configuration of the moving mechanism 6 which adopts the gear system 12 and a mechanism of the type piston rod/crankshaft.

Moreover, advantageously the present solution can be applied both on a disconnector, wherein the moving mechanism 6 disconnects the physical and electrical connection between two terminal contact, and on a changeover switch, wherein the physical and electrical disconnection between two terminal contacts correspond to the establishment of a physical and electrical connection between two others terminal contacts.

Still advantageously, the structure of the switch 1 allows to connect it in a series with a common base, in order to obtain a greater and more complex switch with a space-safe structure.

Another advantage is due to the fact that the moving mechanism 6 itself has a simple configuration and provides a simple operation, so it is difficultly susceptible to important malfunctions and it is simply mendable. Thanks to that, the switch provides a higher reliability and quick and cheap maintenance.

Another advantage is due to the different possible configuration of terminal contacts, which can protrude from different sides of the switch body with minimum variations, that allows to the switch 1 to be mounted in different electrical circuits in different arrangements.

So, the disclosed embodiments are suitable in the most applications wherein a switch in high current is required.

Another aspect of utility of the disclosed embodiments is that it is simply to use by any sector operator, not requiring any specific knowledge but being based only to visible requirements of connections.

Another advantage of the disclosed embodiments is that it does not require particular manufacture, that is important for a component clearly intended for mass-production.

Advantageously, the disconnector according to the disclosed embodiments may be used also in high AC current applications.

Finally, the switch 1 can be implemented in a more complex electrical system.

In the previous lines the directional terms like: "forward", "rearward", "front", "rear", "up", "down", "above", "below", "upward", "downward", "top", "bottom", "side", "vertical", "horizontal", "perpendicular" and "transverse" as well as any other similar directional terms refer just to the device as shown in the drawings and do not relate to a possible use of the same device. Accordingly, these directional terms, as utilized to describe the contactor in its upright vertical position on a horizontal surface have just the meaning to identify a portion of the device with respect to another portion as shown in the figures.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. This concept also applies to words of similar meaning, for example, the terms "have", "include" and their derivatives.

Moreover, the terms "member", "section", "portion", "part" and "element" when used in the singular can have the dual meaning of a single part or a plurality of parts.

The invention claimed is:

1. A switch comprising:

a switch body for containing switch components;

at least two terminal contacts protruding from the switch body;

at least one movable contact movable from an operative position, wherein the movable contact is electrically coupled between the at least two terminal contacts, and a disconnecting position, wherein the movable contact is electrically uncoupled from the at least two terminal contacts;

a moving mechanism including an electrical motor;

a support sliding element for the movable contact driven by the moving mechanism and the electrical motor to move the movable contact between the operative position and the disconnecting position;

the movable contact being a plate rod extended transversely with respect to the support sliding element, and a further third fixed terminal contact, wherein at least one terminal contact of the at least two terminal contacts is connected to a contact bar, the contact bar running on the perimeter of the switch body, and wherein two alternative connections are provided between the at least one terminal contact and a second of the at least two terminal contacts and between the at least one terminal contact and the third fixed terminal contact, respectively, depending on the position of the movable contact along the contact bar.

2. The switch of claim 1, further comprising at least one releasable gripper for each position of the movable contact for gripping at least one end of the movable contact.

3. The switch of claim 2, comprising at least two releasable grippers fixed in the switch body in correspondence of each position to be reached by the movable contact and wherein the at least two releasable grippers are located in these positions at two opposite ends of the movable contact.

4. The switch of claim 1, further comprising at least a guide, centrally extended along a central axis of the switch body, to guide the movable contact between the operative condition and the disconnecting position, the plate rod being extended transversely with respect to the guide.

5. The switch of claim 1, wherein the movable contact establishes a physical and electrical connection between the at least two terminal contacts, and dislodges the physical and electrical connection between the at least two terminal contacts.

6. The switch of claim 1, wherein the moving mechanism is a rotative kinematic mechanism.

7. The switch of claim 6, wherein the rotative kinematic mechanism comprises a gear system, moved by the electric motor, the gear system moving in turn at least a shaft and a rod, the rod being connected to the support sliding element for the movable contact, to move the movable contact between the operative position and the disconnecting position.

8. The switch of claim 1, wherein the electrical motor moves the at least one movable contact between a first position, establishing a physical and electrical connection between two terminal contacts, and a second position, establishing a physical and electrical connection between other two terminal contacts, wherein the third fixed terminal contact, contemporary dislodges the physical and electrical connection of the first position.

9. The switch of claim 1, wherein the movable contact is coupleable to the contact bar in different operative position by at least one connecting element.

10. The switch of claim 1, wherein the switch body is modularly connectable to other switch bodies.

11. An electrical system comprising at least one switch according to claim 1.

* * * * *